US012644059B2

(12) United States Patent
Trevino et al.

(10) Patent No.: US 12,644,059 B2
(45) Date of Patent: Jun. 2, 2026

(54) PROCESS FOR MAKING BRIGHT STOCK BASE OIL PRODUCTS

(71) Applicant: CHEVRON U.S.A. INC., San Ramon, CA (US)

(72) Inventors: Horacio Trevino, Richmond, CA (US); Minghui Zhang, San Ramon, CA (US); Guan-Dao Lei, Walnut Creek, CA (US); Thomas Ralph Farrell, Orinda, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 18/263,123

(22) PCT Filed: Jan. 26, 2022

(86) PCT No.: PCT/US2022/013848
§ 371 (c)(1),
(2) Date: Jul. 26, 2023

(87) PCT Pub. No.: WO2022/164861
PCT Pub. Date: Aug. 4, 2022

(65) Prior Publication Data

US 2024/0084204 A1 Mar. 14, 2024

Related U.S. Application Data

(60) Provisional application No. 63/141,962, filed on Jan. 26, 2021.

(51) Int. Cl.

| | |
|---|---|
| ***C10G 45/48*** | (2006.01) |
| ***C10G 45/60*** | (2006.01) |
| ***C10G 65/12*** | (2006.01) |

(52) U.S. Cl.
CPC ..... *C10G 45/48* (2013.01); *C10G 45/60* (2013.01); *C10G 65/12* (2013.01);
(Continued)

(58) Field of Classification Search
CPC ..... C10G 45/48; C10G 45/60; C10G 65/12; C10G 2300/302; C10G 2300/308;
(Continued)

(56) References Cited

U.S. PATENT DOCUMENTS

| | | | |
|---|---|---|---|
| 3,654,133 | A | 4/1972 | Olsen |
| 3,852,207 | A | 12/1974 | Stangeland |

(Continued)

FOREIGN PATENT DOCUMENTS

| | | | |
|---|---|---|---|
| CN | 105916967 | A | 8/2016 |
| RU | 2008103815 | A | 8/2009 |
| WO | 2017044210 | A1 | 3/2017 |

OTHER PUBLICATIONS

International Search Report, issued on May 2, 2022, during the prosecution of International Application No. PCT/US2022/013848.
(Continued)

*Primary Examiner* — Prem C Singh
*Assistant Examiner* — Juan C Valencia
(74) *Attorney, Agent, or Firm* — Mark Warzel

(57) ABSTRACT

An improved process for making a bright stock base oil from a base oil feedstream comprising an atmospheric resid feedstock, and, optionally, a base oil feedstock, via hydroprocessing. The process generally involves subjecting a base oil feedstream comprising the atmospheric resid to hydrocracking and dewaxing steps, and optionally to hydrofinishing, to produce base oil product(s) including a bright stock grade base oil product having a viscosity of at least about 22 cSt at 100° C. The invention is useful to make
(Continued)

heavy grade base oil products such as bright stock, as well as Group II and/or Group III/III+ base oils.

26 Claims, 1 Drawing Sheet

(52) U.S. Cl.
CPC . *C10G 2300/302* (2013.01); *C10G 2300/308* (2013.01); *C10G 2400/10* (2013.01)

(58) Field of Classification Search
CPC .... C10G 2400/10; C10G 45/44; C10G 45/58; C10G 47/00; C10G 65/14; C10G 2300/202; C10G 2300/107
See application file for complete search history.

(56) References Cited

U.S. PATENT DOCUMENTS 3,929,616 A 12/1975 Mead
4,673,487 A 6/1987 Miller
4,859,312 A 8/1989 Miller
5,135,638 A 8/1992 Miller
5,158,665 A 10/1992 Miller
5,282,958 A 2/1994 Santilli
5,300,210 A 4/1994 Zones
5,358,627 A * 10/1994 Mears ..... C10G 65/12 208/100
6,156,695 A 12/2000 Soled
6,162,350 A 12/2000 Soled
6,274,530 B1 8/2001 Cayton
6,299,760 B1 10/2001 Soled
6,566,296 B2 5/2003 Plantenga
6,620,313 B1 9/2003 Demmin
6,635,599 B1 10/2003 Sonja
6,652,738 B2 11/2003 Eijsbouts
6,758,963 B1 7/2004 Hantzer
6,783,663 B1 8/2004 Lloyd
6,860,987 B2 3/2005 Plantenga
7,179,366 B2 2/2007 Harle
7,229,548 B2 6/2007 Riley
7,232,515 B1 6/2007 Demmin
7,282,134 B2 10/2007 Abernathy
7,288,182 B1 10/2007 Soled
7,544,285 B2 6/2009 Domokos
7,615,196 B2 11/2009 Bhan
7,803,735 B2 9/2010 Maesen
7,807,599 B2 10/2010 Maesen
7,816,298 B2 10/2010 Maesen
7,838,696 B2 11/2010 Maesen
7,910,761 B2 3/2011 Maesen
7,931,799 B2 4/2011 Dykstra
7,964,524 B2 6/2011 Kuperman
7,964,525 B2 6/2011 Dykstra
7,964,526 B2 6/2011 Maesen
8,058,203 B2 11/2011 Dykstra
9,988,585 B2 6/2018 Hayasaka
10,196,575 B2 2/2019 Zhan
2015/0136646 A1 5/2015 Zhan
2016/0115403 A1 4/2016 Macris
2016/0145503 A1 5/2016 Xu
2016/0145511 A1 5/2016 Xu et al.
2017/0183577 A1* 6/2017 Hilbert ..... C10M 101/02

OTHER PUBLICATIONS

Written Opinion of the International Searching Authority, issued on May 2, 2022, during the prosecution of International Application No. PCT/US2022/013848.
Speight. "Synthetic fuels handbook." McGraw-Hill Companies Inc., New York, 2008, pp. 64, 85, and 121.

* cited by examiner

PROCESS FOR MAKING BRIGHT STOCK BASE OIL PRODUCTS

CROSS REFERENCE TO RELATED APPLICATIONS

This application is related to the following applications, and claims the benefit of priority thereto, as a 371 application of PCT/US2022/013848, filed on Jan. 26, 2022, which is the international application based on U.S. Provisional Appl. Ser. No. 63/141,962, filed on Jan. 26, 2021, the disclosures of which are herein incorporated in their entirety.

FIELD OF THE INVENTION

The invention concerns a process for making a bright stock base oil product by combining an atmospheric resid feedstock with a base oil feedstock to form a combined feedstream and forming a bright stock base oil product therefrom via hydroprocessing.

BACKGROUND OF THE INVENTION

High quality lubricating base oils, such as those having a viscosity index (VI) of 120 or greater (Group II and Group III), may generally be produced from high-boiling point vacuum distillates, such as vacuum gas oils (VGO), by hydrocracking to raise VI, followed by catalytic dewaxing to lower pour point and cloud point, and followed by hydrofinishing to saturate aromatics and improve stability. In hydrocracking, high-boiling molecules are cracked to lower-boiling molecules which raises VI but also lowers the viscosity and yield. In order to make a high VI and high viscosity grade base oil at high yield, the hydrocracker feed must contain a certain quantity of high-boiling molecules. Typically, VGOs are limited in their ability to recover very high-boiling molecules from atmospheric resid (AR) in a vacuum column because of practical limits on temperature and pressure. One possible means of feeding higher-boiling molecules to the hydrocracker is to feed the AR directly, but such an approach is not normally possible or workable because the AR usually contains materials that are extremely harmful to the hydrocracker catalyst, including, e.g., nickel, vanadium, micro-carbon residue (MCR) and asphaltenes. These materials shorten the hydrocracker catalyst life to an unacceptable degree, making the use of such feeds impracticable.

One approach to using difficult whole crude and other intermediate feeds for making base oils is to first process the feed, such as AR or vacuum resid (VR), in a solvent deasphalting (SDA) unit. Such treatment is usually necessary to separate the bulk of undesirable materials while producing a deasphalted oil (DAO) of acceptable hydrocracker feed quality. The very high capital requirements and high operating cost of such SDA units, and the overall process approach, make them undesirable alternatives, however. Other approaches that attempt to minimize or eliminate the need for solvent deasphalting steps have been implemented but have not provided a clear benefit in terms of cost or other process improvements.

The production of Group III base oils and finished motor oils has usually required the use of expensive and supply-limited viscosity index improvers such as polyalphaolefins, or other expensive processing techniques, such as the use of gas-to-liquid (GTL) feedstocks or, e.g., through multi-hydrocracking processing of mineral oils. The production of Group III base oils also generally requires high quality feedstock(s) and processing at high conversion to meet VI targets at the expense of product yield. Despite continuing industry efforts, however, a comparatively inexpensive and suitable feedstock, and a simplified process for making such products, remains to be developed and commercialized.

Extra-heavy higher grades of base oils cannot typically be economically made using conventionally available crudes, in part because such feedstocks do not usually contain sufficient amounts of molecular species useful to produce such heavy grades. The end point of typical vacuum gas oil (VGO) feed cuts used to make heavy neutral (HN) base oils is only 1050 to 1100° F., with base oil products limited to viscosities in the 11 to 12 cSt range (measured at 100° C.). The molecules required to make heavier grades of base oils, are not present in significant amounts in these typically available feed cuts. Processing such feeds to produce heavier cuts would introduce excessive amounts of heteroatoms (such as nitrogen) and aromatics and require extensive pretreatment and high-severity conversion. The resulting low yields would make such a process uneconomical using typically available feeds. As such, a process utilizing feeds that are suitable to produce heavier grades of base oils, e.g., feeds that are of higher purity, lower aromatics content and higher VI in the high boiling range of interest would be desirable as sources to produce heavy base oil products.

The foregoing considerations are also of concern for heavier grade bright stock base oils. Bright stocks are very high viscosity base oils with normal boiling points (NBP) of 1000° F. or higher and viscosities in the range of about 22 (or higher) to about 30 cSt at 100° F. The molecular compositions of such bright stock base oils are normally beyond the range of typical VGO stocks used for producing neutral oils like 600N and other products. Bright stock is usually made from vacuum resid (VR) or atmospheric resid (AR) feedstocks. Since both VR and AR contain fairly large concentrations of molecules that are unsuitable for base oil like asphaltenes, microcarbon residue (MCR), and nitrogen-containing molecules, in addition to catalyst poisons like nickel and vanadium-containing molecules, such feedstocks must typically be pretreated to upgrade the quality. Typically, such VR and AR are sufficiently pretreated in a solvent deasphalting unit using propane solvent (PDA) to enable acceptable yield and catalyst life in the base oil hydrocracker (HCR). The HCR then treats and cracks the deasphalted oil (DAO) to raise viscosity index (VI) and produce waxy bright stock. The waxy bright stock is then dewaxed to lower pour point and cloud point, followed by hydrofinishing to remove trace impurities.

Despite the progress in producing base oils from differing and challenging feeds, a continuing need therefore exists for improved processes to both utilize different feedstocks and to increase the yield of valuable heavier grade base oil products, including bright stock base oils.

SUMMARY OF THE INVENTION

The present invention is directed to a process for making a bright stock base oil product through hydroprocessing of a base oil feedstream. While not necessarily limited thereto, one of the goals of the invention is to provide a process for producing bright stock that does not require solvent deasphalting of the feedstocks. An additional goal is to provide increased bright stock base oil yield.

In general, a first process according to the invention comprises making a bright stock base oil by providing an atmospheric resid feedstock, optionally combined with a conventional base oil feedstock, as a base oil feedstream;

contacting the base oil feedstream with a hydrocracking catalyst under hydrocracking conditions to form a hydrocracked product; separating the hydrocracked product into a gaseous fraction and a liquid fraction; contacting the liquid fraction with a hydrodewaxing catalyst under hydroisomerization conditions, to produce a dewaxed product; and, optionally, contacting the dewaxed product with a hydrofinishing catalyst under hydrofinishing conditions to produce a hydrofinished dewaxed product. In general, the atmospheric resid feedstock has an API gravity greater than about 25° API, a nickel and vanadium content of less than about 2 ppm, an MCR of less than about 1 wt. % and an asphaltenes content of less than about 500 ppm. The process produces a bright stock base oil product having a viscosity of at least about 22 cSt at 100° C. In some aspects, the process may also provide a beneficial yield improvement for one or more base oil products as compared with the use of a feedstock that does not include an atmospheric resid feedstock component.

The invention also relates to a method for modifying a base oil process to produce a bright stock base oil through the addition of an atmospheric resid feedstock to a base oil feedstock in a conventional base oil process that comprises subjecting a base oil feedstream to hydrocracking and dewaxing steps to form a dewaxed product comprising a light product and a heavy product. As such, the modified bright stock base oil process comprises combining an atmospheric resid feedstock and a base oil feedstock to form a base oil feedstream; contacting the base oil feedstream with a hydrocracking catalyst under hydrocracking conditions to form a hydrocracked product; separating the hydrocracked product into at least a gaseous fraction and a liquid fraction; contacting the liquid fraction with a hydrodewaxing catalyst under hydroisomerization conditions, to produce a dewaxed product; and, optionally, contacting the dewaxed product with a hydrofinishing catalyst under hydrofinishing conditions to produce a hydrofinished dewaxed product. In general, the atmospheric resid feedstock has an API gravity greater than about 25° API, a nickel and vanadium content of less than about 2 ppm, an MCR of less than about 1 wt. % and an asphaltenes content of less than about 500 ppm. The modified process produces a bright stock base oil product having a viscosity of at least about 22 cSt at 100° C. and may also provide beneficial yield improvements for one or more base oil products as compared with the use of a feedstock that does not include an atmospheric resid feedstock component.

The invention further relates to a process for making a bright stock base oil having a viscosity of at least about 22 cSt at 100° C. by separating a base oil feedstream comprising an atmospheric resid feedstock, and, optionally, a base oil feedstock into a vacuum gas oil having a front end cut point of about 700° F. or greater and a back end cut point of about 900° F. or less to form a medium vacuum gas oil MVGO fraction and a heavy vacuum gas oil HVGO; contacting the HVGO fraction with a hydrocracking catalyst under hydrocracking conditions to form a hydrocracked product; separating the hydrocracked product into a gaseous fraction and a liquid fraction; hydrodewaxing the liquid fraction to produce a dewaxed product; and optionally, hydrofinishing of the dewaxed product to produce a hydrofinished dewaxed product. In general, the atmospheric resid feedstock has an API gravity greater than about 25° API, a nickel and vanadium content of less than about 2 ppm, an MCR of less than about 1 wt. % and an asphaltenes content of less than about 500 ppm. The process produces a bright stock base oil product having a viscosity of at least about 22 cSt at 100° C. as compared with the use of a feedstock that does not include an atmospheric resid feedstock component.

The invention further provides a process for making a base oil product from the medium vacuum gas oil MVGO fraction by contacting the MVGO fraction with a hydrocracking catalyst under hydrocracking conditions to form a hydrocracked product; separating the hydrocracked product into a gaseous fraction and a liquid fraction; contacting the liquid fraction with a dewaxing catalyst under hydroisomerization conditions, to produce a dewaxed product; and, optionally, contacting the dewaxed product with a hydrofinishing catalyst under hydrofinishing conditions to produce a hydrofinished dewaxed product; wherein, the dewaxed product and/or the hydrofinished dewaxed product has a viscosity index of 120 or greater after dewaxing.

BRIEF DESCRIPTION OF THE DRAWINGS

The scope of the invention is not limited by any representative figures accompanying this disclosure and is to be understood to be defined by the claims of the application.

DETAILED DESCRIPTION

Figure 1:
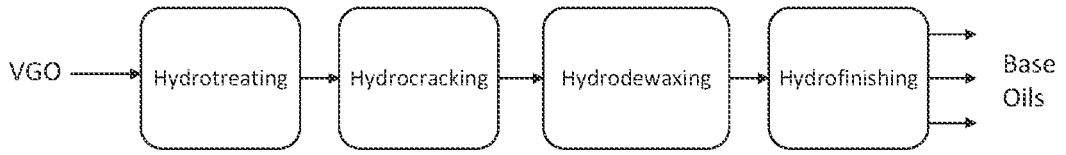
FIG. 1 (prior art)
FIG. 1 is a general block diagram schematic illustration of a prior art process to make a base oil product.

Although illustrative embodiments of one or more aspects are provided herein, the disclosed processes may be implemented using any number of techniques. The disclosure is not limited to the illustrative or specific embodiments, drawings, and techniques illustrated herein, including any exemplary designs and embodiments illustrated and described herein, and may be modified within the scope of the appended claims along with their full scope of equivalents.

Unless otherwise indicated, the following terms, terminology, and definitions are applicable to this disclosure. If a term is used in this disclosure but is not specifically defined herein, the definition from the IUPAC Compendium of Chemical Terminology, 2nd ed (1997), may be applied, provided that definition does not conflict with any other disclosure or definition applied herein, or render indefinite or non-enabled any claim to which that definition is applied. To the extent that any definition or usage provided by any document incorporated herein by reference conflicts with the definition or usage provided herein, the definition or usage provided herein is to be understood to apply.

"API Base Oil Categories" are classifications of base oils that meet the different criteria shown in Table 1:

TABLE 1

Base Oil Stock Properties (4 cSt @100° C. viscosity stocks, no additives)

| Group Designation | Composition | Sulfur, wt. % | Saturates, wt. % | Viscosity Index, VI | Volatility, % | Polarity | Pour Point, ° C. | Flash Point, ° C. |
|---|---|---|---|---|---|---|---|---|
| Group I | Distilled, solvent refined, ≥10% aromatics | >0.03 | and/ or <90 | 80-119 | 15-20 | med-high | −5 to 15 | 100 |
| Group II | Distilled, solvent refined, hydrocracked, <10% aromatics | ≤0.03 | and ≥90 | 80-119 | 10-15 | med | −10 to −20 | 170 |
| Group III | Distilled, solvent refined, severely hydrocracked, <10% aromatics | ≤0.03 | and ≥90 | ≥120 | 5-15 | med | −10 to 25 | 190 |
| Group III+ | Group III oils additionally hydroisomerized, or otherwise processed, <1% aromatics | — | — | ≥130 | ≤5 | low | −15 to −30 | 200 |
| Group IV | Polyalphaolefins (PAO) 100% catalytically synthesized from olefins derived from thermally cracking wax | — | — | 135-140 | 1.8 | low | −53 | 270 |
| Group V | 100% catalytically synthesized by reacting acids and alcohols; All base oils not included in Groups I-IV | — | — | 140 | 1.0 | high | −21 | 260 |

"API gravity" refers to the gravity of a petroleum feedstock or product relative to water, as determined by ASTM D4052-11 or ASTM D1298, typically performed using commercially available petroleum analysis equipment.

"ISO-VG" refers to the viscosity classification that is recommended for industrial applications, as defined by IS03448:1992.

"Viscosity index" (VI) represents the temperature dependency of a lubricant, as determined by ASTM D2270-10 (E2011), typically performed using commercially available petroleum analysis equipment.

"Micro-Carbon Residue" (MCRT) represents the amount of carbon residue formed as determined by ASTM D4530, typically performed using commercially available petroleum analysis equipment.

"Aromatic Extraction" is part of a process used to produce solvent neutral base oils. During aromatic extraction, vacuum gas oil, deasphalted oil, or mixtures thereof are extracted using solvents in a solvent extraction unit. The aromatic extraction creates a waxy raffinate and an aromatic extract, after evaporation of the solvent.

"Atmospheric resid" or "atmospheric residuum" (AR) is a product of crude oil distillation at atmospheric pressure in which volatile material has been removed during distillation. AR cuts are typically derived at 650° F. up to a 680° F. cut point.

"Vacuum gas oil" (VGO) is a byproduct of crude oil vacuum distillation that can be sent to a hydroprocessing unit or to an aromatic extraction for upgrading into base oils. VGO generally comprises hydrocarbons with a boiling range distribution between 343° C. (649° F.) and 538° C. (1000° F.) at 0.101 MPa. As used herein the term "medium vacuum gas oil", abbreviated as "MVGO" refers to a vacuum gas oil, or a portion thereof, including, e.g., wherein the MVGO is a vacuum gas oil, or a portion thereof, having a front end cut point of about 700° F. or greater and a back end cut point of about 900° F. or less. The term "heavy vacuum gas oil", abbreviated as "HVGO", refers to a heavy vacuum gas oil, or a portion thereof, including, e.g., a fraction derived from a VGO. In some cases, HVGO may be derived from a VGO feedstock in which an MVGO cut portion has been separated from the VGO feedstock, leaving the remainder as the HVGO portion. For example, the heavy vacuum gas oil (HVGO) may be the remainder obtained from a VGO feedstock in which an MVGO portion has been removed, the MVGO portion having a front end cut point of about 700° F. or greater and a back end cut point of about 900° F. or less.

"Deasphalted oil" (DAO) generally refers to the residuum from a vacuum distillation unit that has been deasphalted in a solvent deasphalting process. Solvent deasphalting in a refinery is described in J. Speight, Synthetic Fuels Handbook, ISBN 007149023X, 2008, pages 64, 85-85, and 121.

"Treatment," "treated," "upgrade," "upgrading" and "upgraded," when used in conjunction with an oil feedstock, describes a feedstock that is being or has been subjected to hydroprocessing, or a resulting material or crude product, having a reduction in the molecular weight of the feedstock, a reduction in the boiling point range of the feedstock, a reduction in the concentration of asphaltenes, a reduction in the concentration of hydrocarbon free radicals, and/or a reduction in the quantity of impurities, such as sulfur, nitrogen, oxygen, halides, and metals.

"Solvent Dewaxing" is a process of dewaxing by crystallization of paraffins at low temperatures and separation by filtration. Solvent dewaxing produces a dewaxed oil and slack wax. The dewaxed oil can be further hydrofinished to produce base oil.

"Hydroprocessing" refers to a process in which a carbonaceous feedstock is brought into contact with hydrogen and a catalyst, at a higher temperature and pressure, for the purpose of removing undesirable impurities and/or converting the feedstock to a desired product. Examples of hydroprocessing processes include hydrocracking, hydrotreating, catalytic dewaxing, and hydrofinishing.

"Hydrocracking" refers to a process in which hydrogenation and dehydrogenation accompanies the cracking/fragmentation of hydrocarbons, e.g., converting heavier hydrocarbons into lighter hydrocarbons, or converting aromatics and/or cycloparaffins (naphthenes) into non-cyclic branched paraffins.

"Hydrotreating" refers to a process that converts sulfur and/or nitrogen-containing hydrocarbon feeds into hydrocarbon products with reduced sulfur and/or nitrogen content, typically in conjunction with hydrocracking, and which generates hydrogen sulfide and/or ammonia (respectively) as byproducts.

"Catalytic dewaxing", or hydroisomerization, refers to a process in which normal paraffins are isomerized to their more branched counterparts in the presence of hydrogen and over a catalyst.

"Hydrofinishing" refers to a process that is intended to improve the oxidation stability, UV stability, and appearance of the hydrofinished product by removing traces of aromatics, olefins, color bodies, and solvents. As used in this disclosure, the term UV stability refers to the stability of the hydrocarbon being tested when exposed to UV light and oxygen. Instability is indicated when a visible precipitate forms, usually seen as Hoc or cloudiness, or a darker color develops upon exposure to ultraviolet light and air. A general description of hydrofinishing may be found in U.S. Pat. Nos. 3,852,207 and 4,673,487.

The term "Hydrogen" or "hydrogen" refers to hydrogen itself, and/or a compound or compounds that provide a source of hydrogen.

"Cut point" refers to the temperature on a True Boiling Point (TBP) curve at which a predetermined degree of separation is reached.

"TBP" refers to the boiling point of a hydrocarbonaceous feed or product, as determined by Simulated Distillation (SimDist) by ASTM D2887-13.

"Hydrocarbonaceous", "hydrocarbon" and similar terms refer to a compound containing only carbon and hydrogen atoms. Other identifiers may be used to indicate the presence of particular groups, if any, in the hydrocarbon (e.g., halogenated hydrocarbon indicates the presence of one or more halogen atoms replacing an equivalent number of hydrogen atoms in the hydrocarbon).

"Group IIB" or "Group IIB metal" refers to zinc (Zn), cadmium (Cd), mercury (Hg), and combinations thereof in any of elemental, compound, or ionic form.

"Group IVA" or" "Group IVA metal" refers to germanium (Ge), tin (Sn) or lead (Pb), and combinations thereof in any of elemental, compound, or ionic form.

"Group V metal" refers to vanadium (V), niobium (Nb), tantalum (Ta), and combinations thereof in their elemental, compound, or ionic form.

"Group VIB" or "Group VIB metal" refers to chromium (Cr), molybdenum (Mo), tungsten (W), and combinations thereof in any of elemental, compound, or ionic form.

"Group VIII" or "Group VIII metal" refers to iron (Fe), cobalt (Co), nickel (Ni), ruthenium (Ru), rhenium (Rh), rhodium (Ro), palladium (Pd), osmium (Os), iridium (Ir), platinum (Pt), and combinations thereof in any of elemental, compound, or ionic form.

The term "support", particularly as used in the term "catalyst support", refers to conventional materials that are typically a solid with a high surface area, to which catalyst materials are affixed. Support materials may be inert or participate in the catalytic reactions, and may be porous or non-porous. Typical catalyst supports include various kinds of carbon, alumina, silica, and silica-alumina, e.g., amorphous silica aluminates, zeolites, alumina-boria, silica-alumina-magnesia, silica-alumina-titania and materials obtained by adding other zeolites and other complex oxides thereto.

"Molecular sieve" refers to a material having uniform pores of molecular dimensions within a framework structure, such that only certain molecules, depending on the type of molecular sieve, have access to the pore structure of the molecular sieve, while other molecules are excluded, e.g., due to molecular size and/or reactivity. Zeolites, crystalline aluminophosphates and crystalline silicoaluminophosphates are representative examples of molecular sieves.

W220 and W600 refer to waxy medium and heavy Group II base oil product grades, with W220: referring to a waxy medium base oil product having a nominal viscosity of about 6 cSt at 100° C., and W600: referring to a waxy heavy base oil product having a nominal viscosity of about 12 cSt at 100° C. Following dewaxing, typical test data for Group II base oils are as follows:

| Property | Standard Test | 220N | 600N |
|---|---|---|---|
| API Base Stock Category | (API 1509 E.1.3) | Group II | Group II |
| API Gravity | ASTM D1298 | 32.1 | 31.0 |
| Specific Gravity at 60/60° F. | ASTM D1298 | 0.865 | 0.871 |
| Density, lb/gal | ASTM D1298 | 7.202 | 7.251 |
| Viscosity, Kinematic | ASTM D445 | | |
| cSt at 40° C. | | 41.0 | 106 |
| cSt at 100° C. | | 6.3 | 12.0 |
| Viscosity, Saybolt SUS at 100° F. | ASTM D2161 | 212 | 530 |
| Viscosity Index | ASTM D2270 | 102 | 102 |
| Pour Point, ° C. | ASTM D97 | −15 | −15 |
| Evaporation Loss, NOACK, wt % | CEC-L-40-A-93 | 11 | 2 |
| Flash Point, COC, ° C. | ASTM D92 | 230 | 265 |
| Color | ASTM D1500 | L 0.5 | L 0.5 |
| Sulfur, ppm | Chevron | <6 | <6 |
| Water, ppm | ASTM D1744 | <50 | <50 |
| Saturates, HPLC, wt % | Chevron | >99 | >99 |
| Aromatics, HPLC, wt % | Chevron | <1 | <1 |

In this disclosure, while compositions and methods or processes are often described in terms of "comprising" various components or steps, the compositions and methods may also "consist essentially of" or "consist of" the various components or steps, unless stated otherwise.

The terms "a," "an," and "the" are intended to include plural alternatives, e.g., at least one. For instance, the disclosure of "a transition metal" or "an alkali metal" is meant to encompass one, or mixtures or combinations of more than one, transition metal or alkali metal, unless otherwise specified.

All numerical values within the detailed description and the claims herein are modified by "about" or "approximately" the indicated value, and take into account experimental error and variations that would be expected by a person having ordinary skill in the art.

In one aspect, the present invention is a process for making a bright stock base oil having a viscosity of at least about 22 cSt at 100° C., comprising contacting a base oil feedstream comprising an atmospheric resid feedstock, and, optionally, a base oil feedstock, with a hydrocracking catalyst under hydrocracking conditions to form a hydrocracked product; separating the hydrocracked product into a gaseous fraction and a liquid fraction; contacting the liquid fraction with a dewaxing catalyst under hydroisomerization conditions, to produce a dewaxed product; and optionally, contacting the dewaxed product with a hydrofinishing catalyst under hydrofinishing conditions to produce a hydrofinished dewaxed product; wherein the process produces a bright stock base oil product having a viscosity of at least about 22 cSt at 100° C.

The base oil feedstock generally meets one or more of the following property conditions:

API gravity in the range of 15-40 or 15-30 or 15-25, or at least 15, or at least 17, optionally, less than the atmospheric resid feedstock;

VI in the range of 30-90 or 40-90 or 50-90 or 50-80, optionally, less than the VI of the atmospheric resid feedstock;

viscosity at 100° C. in the range of 3-30 cSt or 3-25 cSt or 3-20 cSt, or at least 3 cSt, or at least 4 cSt;

viscosity at 70° C. in the range of 5-50 cSt or 5-80 wt. % or 5-70 wt. % or 5-60 wt. % or 5-50 wt. % or 5-40 wt. % or 5-30 wt. % or 5-20 cSt or 5-15 cSt, or at least 5 cSt, or at least 6 cSt;

hot $C_7$ asphaltene content in the range of 0.01-0.3 wt. % or 0.01-0.2 wt. % or 0.02-0.15 wt. %, or less than 0.3 wt. %, or less than 0.2 wt. %;

wax content in the range of 5-90 wt. % or 5-80 wt. % or 5-70 wt. % or 5-60 wt. % or 5-50 wt. % or 5-40 wt. % or 5-30 wt. % or 10-25 wt. %, or at least 5 wt. % or at least 10 wt. %, or at least 15 wt. %, or, optionally, less than the wax content of the atmospheric resid feedstock;

nitrogen content of less than 2500 ppm or less than 2000 ppm or less than 1500 ppm or less than 1000 ppm, or in the range of 1000-5000 ppm, or 2000-5000 ppm, or 1000-4000 ppm, or 1000-3000 ppm;

sulfur content of less than 40000 ppm, or less than 35000 ppm, or less than 30000 ppm, or less than 25000 ppm, or less than 20000 ppm, or less than 15000 ppm, or less than 10000 ppm, or in the range of 1000-40000 ppm or 1000-35000 ppm or 1000-30000 ppm or 1000-25000 ppm or 1000-15000 ppm or 1000-10000 ppm; and/or 1050+° F. content of less than 10 wt. %, or less than 8 wt. %, or less than 7 wt. %, or less than 6 wt. %, or less than 5 wt. %, or less than 4 wt. %, or less than 3 wt. %, or less than 2 wt. %, or in the range of 2-15 wt. % or 2-10 wt. % or 1-7 wt. %, optionally, less than the 1050+° F. content of the atmospheric resid feedstock.

In some aspects, the base oil feedstock has a nitrogen content of less than 2500 ppm or less than 2000 ppm or less than 1500 ppm or less than 1000 ppm, or in the range of 1000-5000 ppm, or 2000-5000 ppm, or 1000-4000 ppm, or 1000-3000 ppm; or a sulfur content of less than 40000 ppm, or less than 35000 ppm, or less than 30000 ppm, or less than 25000 ppm, or less than 20000 ppm, or less than 15000 ppm, or less than 10000 ppm, or in the range of 1000-40000 ppm or 1000-35000 ppm or 1000-30000 ppm or 1000-25000 ppm or 1000-15000 ppm or 1000-10000 ppm; or a 1050+° F. content of less than 10 wt. %, or less than 8 wt. %, or less than 7 wt. %, or less than 6 wt. %, or less than 5 wt. %, or less than 4 wt. %, or less than 3 wt. %, or less than 2 wt. %, or in the range of 2-15 wt. % or 2-10 wt. % or 1-7 wt. %, optionally, less than the 1050+° F. content of the atmospheric resid feedstock, or a combination thereof.

Suitable base oil feedstocks may be from any crude oil feedstock, or a fraction thereof, including hydroprocessed intermediate streams or other feeds. Generally, the base oil feedstock contains materials boiling within the base oil range. Feedstocks may include atmospheric and vacuum residuum from a variety of sources, including whole crudes, and paraffin-based crudes.

The atmospheric resid (AR) feedstock generally meets one or more of the following property conditions:

API gravity in the range of 20-60 or 20-45 or 25-45, or at least 20, or at least 22, or, optionally, greater than the API of the base oil feedstock;

VI in the range of 50-200, or 70-190, or 90-180, or at least 80, or, optionally, greater than the VI of the base oil feedstock;

viscosity at 100° C. in the range of 3-30 cSt, or 3-25 cSt, or 3-20 cSt, or 3-10 cSt, or at least 3 cSt, or at least 4 cSt, or less than 10 cSt;

viscosity at 70° C. in the range of 5-50 cSt or 5-30 cSt, or 5-20 cSt, or 5-15 cSt, or at least 5 cSt, or at least 6 cSt;

hot $C_7$ asphaltene content in the range of a bout 0.01-0.3 wt. % or about 0.01-0.2 wt. % or about 0.02-0.15 wt. %, or less than about 0.3 wt. %, or less than about 0.2 wt. %, or less than about 0.1 wt. %;

wax content in the range of 5-90 wt. %, or 5-80 wt. %, or 5-70 wt. %, or 5-60 wt. %, or 5-50 wt. %, or 5-40 wt. %, or 5-30 wt. %, or 10-25 wt. %, or at least 5 wt. %, or at least 10 wt. %, or at least 15 wt. %, or, optionally, greater than the wax content of the base oil feedstock;

nitrogen content of less than 2500 ppm, or less than 2000 ppm, or less than 1500 ppm, or less than 1000 ppm, or less than 800 ppm, or less than 500 ppm, or less than 200 ppm, or less than 100 ppm;

sulfur content of less than 8000 ppm, or less than 6000 ppm, or less than 4000 ppm, or less than 3000 ppm, or less than 2000 ppm, or less than 1000 ppm, or less than 500 ppm, or less than 200 ppm, or in the range of 100-8000 ppm, or 100-6000 ppm, or 100-4000 ppm, or 100-2000 ppm, or 100-1000 ppm, or 100-500 ppm, or 100-200 ppm; and/or 1050+° F. content in the range of 2-50 wt. %, 2-40 wt. %, or 4-50 wt. %, or 4-40 wt. %, or 8-50 wt. %, or 8-40 wt. %, or up to 50 wt. %, or up to 40 wt. %, or up to 30 wt. %, or up to 20 wt. %, or up to 10 wt. %, optionally, greater than the 1050+° F. content of the base oil feedstock.

In some aspects, AR feedstocks having property characteristics described herein may be advantageously derived from a light tight oil (LTO, e.g., shale oil typically having an API of >45). Suitable feedstocks may be Permian Basin feedstocks and elsewhere, including Eagle Ford, Avalon, Magellan, Buckeye, and the like.

The atmospheric resid (AR) feedstock generally differs from conventional AR feedstocks. For example, the AR feedstock typically differs in one of more of the foregoing feedstock properties from conventional AR feedstocks, with AR feedstocks useful in the invention having generally lower property values and ranges. In more particular cases, as compared with conventional AR's, the AR feedstock has lower hot $C_7$ asphaltene content, nitrogen and/or sulfur content, 1050+° F. content, metals content (e.g., Nickel, Vanadium, and/or Iron), or a combination thereof.

In some cases, the atmospheric resid feedstock has a hot C-7 asphaltene content in the range of less than about 0.3 wt. %, or less than about 0.2 wt. %, or less than about 0.1 wt. %; and a nitrogen content of less than 2500 ppm, or less than 2000 ppm, or less than 1500 ppm, or less than 1000 ppm, or less than 800 ppm, or less than 500 ppm, or less than 200 ppm, or less than 100 ppm. The atmospheric resid feedstock may also have a hot C-7 asphaltene content in the range of less than about 0.3 wt. %, or less than about 0.2 wt. %, or less than about 0.1 wt. %; a nitrogen content of less than 2500 ppm, or less than 2000 ppm, or less than 1500, ppm or less than 1000 ppm, or less than 800 ppm, or less than 500 ppm, or less than 200 ppm, or less than 100 ppm; and a metals content of: less than about 5 ppm Nickel, or less than about 3 ppm Vanadium, or less than about 4 ppm Iron, or a combination thereof. Still further, the AR feedstock may also meet the following conditions: the atmospheric resid feedstock meets the following conditions: viscosity at 100° C. of less than 10 cSt, or in the range of 3-10 cSt; hot C-7 asphaltene content of less than about 0.1 wt. %, or in the range of about 0.01-0.1 wt. %; MCRT of less than 2 wt. %; nitrogen content of less than 800 ppm; sulfur content of less than 3000 ppm; Nickel content of less than 5 ppm; Vanadium content of less than 3 ppm; and Iron content of less than 4 ppm.

Both the base oil feedstock and the atmospheric resid feedstock may have any of the foregoing properties within any of the noted broad and narrower ranges and combinations of such ranges.

The base oil feedstream generally comprises 5-95 wt. % atmospheric resid feedstock and 95-5 wt. % base oil feedstock, or 10-90 wt. % atmospheric resid feedstock and 90-10 wt. % base oil feedstock, or 10-80 wt. % atmospheric resid feedstock and 90-20 wt. % base oil feedstock, or 10-60 wt. % atmospheric resid feedstock and 90-40 wt. % base oil feedstock, or 10-50 wt. % atmospheric resid feedstock and 50-90 wt. % base oil feedstock, or 10-40 wt. % atmospheric resid feedstock and 90-60 wt. % base oil feedstock, or 10-30 wt. % atmospheric resid feedstock and 90-70 wt. % base oil feedstock, or 30-60 wt. % atmospheric resid feedstock and 70-40 wt. % base oil feedstock, or 40-60 wt. % atmospheric resid feedstock and 60-40 wt. % base oil feedstock.

In certain embodiments, the base oil feedstream does not contain an added whole crude oil feedstock, and/or does not contain a vacuum residue feedstock, and/or does not contain a deasphalted oil feedstock component, and/or contains only atmospheric resid feedstock and base oil feedstock. While some of the particular property characteristics of the base oil feedstock and the AR feedstock may have similar or overlapping property values or ranges of values, the base oil feedstock and the AR feedstock are not the same since typically one or more property characteristics will be significantly different. For example, in some cases, the atmospheric resid feedstock and the base oil feedstock differ in their respective nitrogen content, sulfur content, 1050+° F. content, or a combination thereof.

While not limited to a straight run process, the process need not include recycle of a liquid feedstock as part of the base oil feedstream or as either or both of the atmospheric resid feedstock and the base oil feedstock. In certain embodiments, recycle of one or more intermediate streams may be used, however.

The base oil feedstock may comprise vacuum gas oil, or consist essentially of vacuum gas oil, or consist of vacuum gas oil, including whole uncut feedstocks and cut feedstocks. The vacuum gas oil may be a heavy vacuum gas oil obtained from vacuum gas oil that is cut into a light fraction and a heavy fraction, with the heavy fraction having a cut point temperature range of about 950-1050° F. The VGO may be a blend derived from various feedstocks, as well, and may include defined boiling point range components in differing amounts. For example, one component of the VGO derived from a particular feedstock may have a higher 1050+° F. content while other VGO components contribute lower 1050+° F. content to the VGO.

The dewaxed product and/or the hydrofinished dewaxed product is typically obtained as a light base oil product and a heavy base oil product. The light base oil product generally has a nominal viscosity in the range of about 3-9 cSt, or 4-8 cSt or 5-7 cSt at 100° C. and/or with the heavy base oil product generally having a nominal viscosity in the range of 13-24 cSt or 13-21 cSt or 13-18 cSt at 100° C. The dewaxed product may be further separated into at least a light product having a nominal viscosity of about 6 cSt at 100° C., and/or at least a heavy product having a nominal viscosity of 13 cSt or greater at 100° C., or 13-16.5 cSt at 100° C., or about 13-23 cSt at 100° C., or a combination thereof.

One of the advantages associated with the process is that the yield of the heavy base oil product relative to the light base oil product may be increased by at least about 0.5 liquid volume % (Lvol. %), or at least about 1 Lvol. %, or at least about 2 Lvol. %, or at least about 5 Lvol. % compared with the same process that does not include the atmospheric resid feedstock in the lubricating oil feedstream. In some embodiments, the yield of the heavy base oil product may be increased by at least about 0.5 Lvol. %, or at least about 1 Lvol. %, or at least about 2 Lvol. %, or at least about 5 Lvol. %, or at least about 10 Lvol. %, or at least about 20 Lvol. %, compared with the same process that does not include the atmospheric resid feedstock in the base oil feedstream. The total waxy yield may also be increased by at least about 0.5 Lvol. %, or at least about 1 Lvol. %, or at least about 2 Lvol. %, or at least about 5 Lvol. % compared with the same process that does not include the atmospheric resid feedstock in the base oil feedstream.

In another aspect, the invention concerns a method for modifying a conventional or existing base oil process to produce a bright stock base oil product having a viscosity of at least about 22 cSt at 100° C. In particular, a base oil process that comprises subjecting a base oil feedstream to hydrocracking and dewaxing steps to form a dewaxed product comprising a lighter product and a heavier product may be modified according to the invention by subjecting a base oil feedstock comprising atmospheric resid feedstock to the hydrocracking and dewaxing steps of the base oil process to produce a dewaxed product. The dewaxed product may be optionally further contacted with a hydrofinishing catalyst under hydrofinishing conditions to produce a hydrofinished dewaxed product comprising a bright stock product.

The invention further relates to a process for making a bright stock base oil having a viscosity of at least about 22 cSt at 100° C. from a base oil feedstream, or a fraction thereof, comprising providing a base oil feedstream comprising an atmospheric resid feedstock, and, optionally, a base oil feedstock separating the base oil feedstream into a vacuum gas oil having a front end cut point of about 700° F. or greater and a back end cut point of about 900° F. or less to form a medium vacuum gas oil MVGO fraction and a heavy vacuum gas oil HVGO fraction; contacting the HVGO fraction with a hydrocracking catalyst under hydrocracking conditions to form a hydrocracked product; separating the hydrocracked product into a gaseous fraction and a liquid fraction; dewaxing of the liquid fraction to produce a dewaxed product; and optionally, hydrofinishing of the dewaxed product to produce a hydrofinished dewaxed product, such that the process produces at least one bright stock base oil product having a viscosity of at least about 22 cSt at 100° C.

By comparison to the use of a conventional VGO feedstock, the use of a vacuum gas oil having a front end cut point of about 700° F. or greater and a back end cut point of about 900° F. or less, herein referred to as a medium vacuum gas oil (MVGO) provides an improved waxy product yield at a Group III or Group III+ viscosity of 4 cSt 100° C. of the MVGO that is at least about 0.5 lvol. %, or 1 lvol. %, or 2 lvol. %, or 3 lvol. %, or 5 lvol. % greater than the same process that does not include the MVGO as the base oil feedstock.

The invention further relates to a process that combines the two process aspects, i.e., in which a feedstock is used to derive the narrow cut-point MVGO fraction and the same or a different feedstock is used for the atmospheric resid fraction. The combined process for making a base oil, including bright stock, from a base oil feedstock, or a fraction thereof, comprises providing an atmospheric resid fraction from a base oil feedstock, or a fraction thereof; separating the base oil feedstock, or a fraction thereof, and/or the base oil atmospheric resid fraction into a narrow vacuum gas oil cut-point fraction having a front end cut point of about 700° F. or greater and a back end cut point of about 900° F. or less to form an MVGO fraction and a residual HVGO fraction; using the HVGO fraction as the atmospheric resid feedstock in the first process to prepare a dewaxed product and/or hydrofinished dewaxed product; and/or using the MVGO fraction as the base oil feedstock in a second process to prepare a dewaxed product and/or hydrofinished dewaxed product having a viscosity index of 120 or greater after dewaxing, while also producing at least one bright stock base oil product having a viscosity of at least about 22 cSt at 100° C.

In certain embodiments, the base oil feedstock may comprise tight oil, particularly a light tight oil, or a fraction thereof. The narrow vacuum gas oil cut-point fraction may also be derived from the atmospheric resid fraction, including an atmospheric resid fraction derived from light tight oil.

Advantageously, the fractionation of the AR feedstock into MVGO and HVGO fractions provides the ability to produce Group III/III+ base oil product while still allowing the HVGO fraction to be used with a conventional VGO base oil feedstock to produce a heavy grade base oil product, particularly a bright stock base oil product having a viscosity of at least about 22 cSt at 100° C. For example, Group III/III+ products that may be produced include a base oil product having a viscosity of about 4 cSt at 100° C. (e.g., 3-5 cSt at 100° C.). In some embodiments, the use of MVGO to produce Group III/III+ base oil product results in greater yields of such products.

Figure 2A:
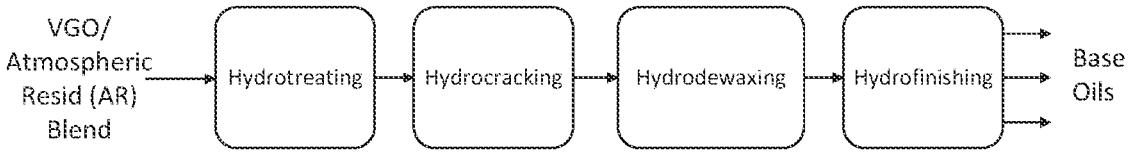
FIG. 2*a* is a general block diagram schematic illustration of an embodiment of a process to make a base oil product using an atmospheric resid (AR) or a blend of vacuum gas oil (VGO) and AR (VGO/AR) according to the invention.
Figure 2B:
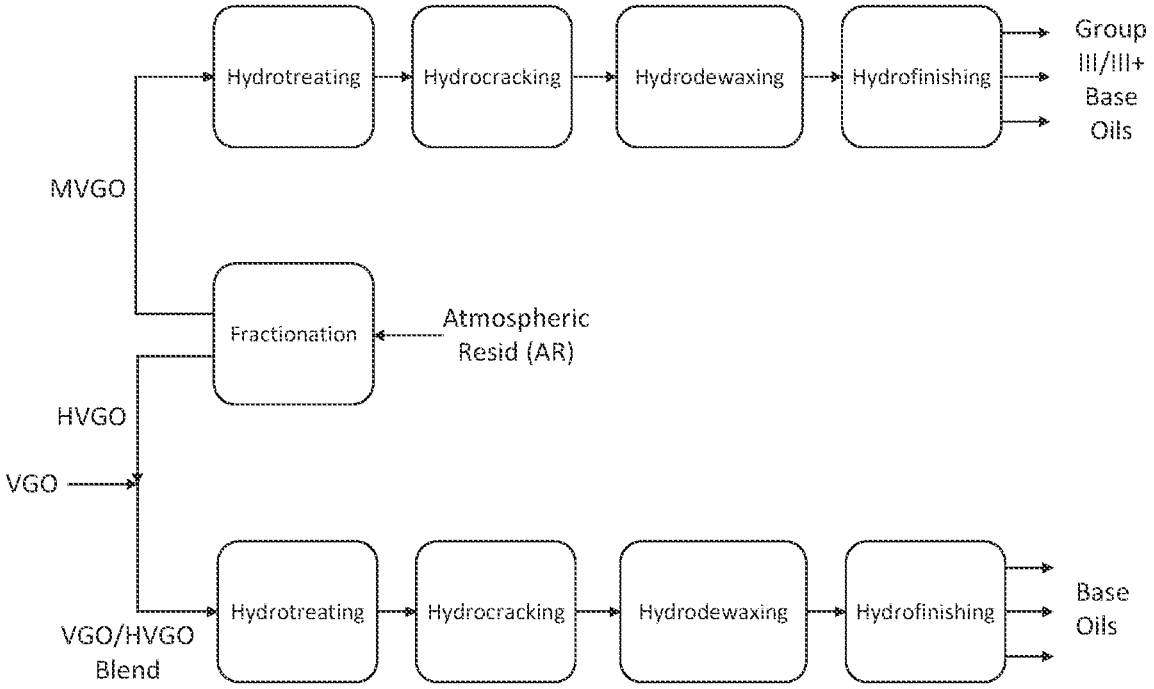
FIG. 2*b* is a general block diagram schematic illustration of an embodiment of a process to make a Group III/III+ base oil product using a medium vacuum gas oil (MVGO) fraction from an atmospheric resid and a heavy base oil product using a heavy vacuum gas oil (HVGO) residual fraction from an atmospheric resid or a blend of VGO and HVGO (VGO/HVGO) according to the invention.

An illustration of a method or process according to an embodiment of the invention is shown schematically in FIG. 2*a*, in which conventional base oil hydrotreating, hydrocracking, hydrodewaxing, and hydrofinishing process steps, conditions, and catalysts are used. By comparison to a prior art base oil process schematic illustrated in FIG. 1, FIG. 2*a* shows the use of a feed blend of VGO and atmospheric resid (AR) where the conventional process typically uses VGO base oil feedstock. FIG. 2*b* further illustrates the use of an AR feedstock to form a medium vacuum gas oil fraction (MVGO) and a heavy VGO fraction (HVGO), with the MVGO fraction feedstream being used to produce a Group III/III+ base oil product and the HVGO fraction feedstream being combined with a conventional VGO base oil feedstock to produce a heavy base oil product, e.g., a product comprising a bright stock base oil product.

Catalysts suitable for use as the hydrocracking, dewaxing, and hydrofinishing catalysts in the process and method and associated process conditions are described in a number of publications, including, e.g., U.S. Pat. Nos. 3,852,207; 3,929,616; 6,156,695; 6,162,350; 6,274,530; 6,299,760; 6,566,296; 6,620,313; 6,635,599; 6,652,738; 6,758,963; 6,783,663; 6,860,987; 7,179,366; 7,229,548; 7,232,515; 7,288,182; 7,544,285, 7,615,196; 7,803,735; 7,807,599; 7,816,298; 7,838,696; 7,910,761; 7,931,799; 7,964,524; 7,964,525; 7,964,526; 8,058,203; 10,196,575; WO 2017/044210; and others. Suitable catalysts generally include supported catalysts, i.e., those catalysts comprising one or more supports as described herein and as known in the art. Unsupported or bulk catalysts, e.g., mixed metal sulfide catalysts as may be described in US 2015/136646, need not generally be used in the present process.

Catalysts suitable for hydrocracking, e.g., comprise materials having hydrogenation-dehydrogenation activity, together with an active cracking component support. Such catalysts are well described in many patent and literature references. Exemplary cracking component supports include silica-alumina, silica-oxide zirconia composites, acid-treated clays, crystalline aluminosilicate zeolitic molecular sieves such as zeolite A, faujasite, zeolite X, and zeolite Y, and combinations thereof. Hydrogenation-dehydrogenation components of the catalyst preferably comprise a metal selected from Group VIII metals and compounds thereof and Group VIB metals and compounds thereof. Preferred Group VIII components include cobalt and nickel, particularly the oxides and sulfides thereof. Preferred Group VIB components are the oxides and sulfides of molybdenum and tungsten. Examples of a hydrocracking catalyst which would be suitable for use in the hydrocracking process step are the combinations of nickel-tungsten-silica-alumina, nickel-molybdenum-silica-alumina and cobalt-molybdenum-silica-alumina. Such catalysts may vary in their activities for hydrogenation and for cracking and in their ability to sustain high activity during long periods of use depending on their compositions and preparation.

Typical hydrocracking reaction conditions include, for example, a temperature of from 450° F. to 900° F. (232° C. to 482° C.), e.g., from 650° F. to 850° F. (343° C. to 454° C.); a pressure of from 500 psig to 5000 psig (3.5 MPa to 34.5 MPa gauge), e.g., from 1500 psig to 3500 psig (10.4 MPa to 24.2 MPa gauge); a liquid reactant feed rate, in terms of liquid hourly space velocity (LHSV) of from 0.1 $hr^{-1}$ to 15 $hr^{-1}$ (v/v), e.g., from 0.25 $hr^{-1}$ to 2.5 $hr^{-1}$; a hydrogen feed rate, in terms of $H_2$/hydrocarbon ratio, of from 500 SCF/bbl to 5000 SCF/bbl (89 to 890 $m^3$ $H_2/m^3$ feedstock) of liquid base oil (lubricating) feedstock, and/or a hydrogen partial pressure of greater than 200 psig, such as from 500 to 3000 psig; and hydrogen re-circulation rates of greater than 500 SCF/B, such as between 1000 and 7000 SCF/B.

Hydrodewaxing is used primarily for reducing the pour point and/or for reducing the cloud point of the base oil by removing wax from the base oil. Typically, dewaxing uses a catalytic process for processing the wax, with the dewaxer feed is generally upgraded prior to dewaxing to increase the viscosity index, to decrease the aromatic and heteroatom content, and to reduce the amount of low boiling components in the dewaxer feed. Some dewaxing catalysts accomplish the wax conversion reactions by cracking the waxy molecules to lower molecular weight molecules. Other dewaxing processes may convert the wax contained in the hydrocarbon feed to the process by wax isomerization, to produce isomerized molecules that have a lower pour point than the non-isomerized molecular counterparts. As used herein, isomerization encompasses a hydroisomerization process, for using hydrogen in the isomerization of the wax molecules under catalytic hydroisomerization conditions.

Dewaxing generally includes processing the dewaxer feedstock by hydroisomerization to convert at least the n-paraffins and to form an isomerized product comprising isoparaffins. Suitable isomerization catalysts for use in the dewaxing step can include, but are not limited to, Pt and/or Pd on a support. Suitable supports include, but are not limited to, zeolites CIT-1, IM-5, SSZ-20, SSZ-23, SSZ-24, SSZ-25, SSZ-26, SSZ-31, SSZ-32, SSZ-32, SSZ-33, SSZ-35, SSZ-36, SSZ-37, SSZ-41, SSZ-42, SSZ-43, SSZ-44, SSZ-46, SSZ-47, SSZ-48, SSZ-51, SSZ-56, SSZ-57, SSZ-58, SSZ-59, SSZ-60, SSZ-61, SSZ-63, SSZ-64, SSZ-65, SSZ-67, SSZ-68, SSZ-69, SSZ-70, SSZ-71, SSZ-74, SSZ-75, SSZ-76, SSZ-78, SSZ-81, SSZ-82, SSZ-83, SSZ-86, SSZ-91, SSZ-95, SUZ-4, TNU-9, ZSM-S, ZSM-12, ZSM-22, ZSM-23, ZSM-35, ZSM-48, EMT-type zeolites, FAU-type zeolites, FER-type zeolites, MEL-type zeolites, MFI-type zeolites, MTT-type zeolites, MTW-type zeolites, MWW-type zeolites, MRE-type zeolites, TON-type zeolites, other molecular sieves materials based upon crystalline aluminophosphates such as SM-3, SM-7, SAPO-II, SAPO-31, SAPO-41, MAPO-II and MAPO-31. Isomerization may also involve a Pt and/or Pd catalyst supported on an acidic support material such as beta or zeolite Y molecular sieves, silica, alumina, silica-alumina, and combinations thereof. Suitable isomerization catalysts are well described in the patent literature, see, e.g., U.S. Pat. Nos. 4,859,312; 5,158,665; and 5,300,210.

Hydrodewaxing conditions generally depend on the feed used, the catalyst used, catalyst pre-treatment, the desired yield, and the desired properties of the base oil. Typical conditions include a temperature of from 500° F. to 775° F. (260° C. to 413° C.); a pressure of from 15 psig to 3000 psig (0.10 MPa to 20.68 MPa gauge); a LHSV of from 0.25 $hr^{-1}$ to 20 $hr^{-1}$; and a hydrogen to feed ratio of from 2000 SCF/bbl to 30,000 SCF/bbl (356 to 5340 $m^3$ $H_2/m^3$ feed). Generally, hydrogen will be separated from the product and recycled to the isomerization zone. Suitable dewaxing conditions and processes are described in, e.g., U.S. Pat. Nos. 5,135,638; 5,282,958; and 7,282,134.

Waxy products W220 and W600 may be dewaxed to form 220N and 600N neutral products that may be suitable (or better suited) for use as a lubricating base oil or in a lubricant formulation. For example, the dewaxed product may be mixed or admixed with existing lubricating base oils in order to create new base oils or to modify the properties of existing base oils, e.g., to meet particular target conditions, such as viscometric or Noack target conditions, for particular base oil grades like 220N and 600N. Isomerization and blending can be used to modulate and maintain pour point and cloud point of the base oil at suitable values. Normal paraffins may also be blended with other base oil components prior to undergoing catalytic isomerization, including blending normal paraffins with the isomerized product. Lubricating base oils that may be produced in the dewaxing step may be treated in a separation step to remove light product. The lubricating base oil may be further treated by distillation, using atmospheric distillation and optionally vacuum distillation to produce a lubricating base oil.

Typical hydrotreating conditions vary over a wide range. In general, the overall LHSV is about 0.25 $hr^{-1}$ to 10 $hr^{-1}$ (v/v), or alternatively about 0.5 $hr^{-1}$ to 1.5 $hr^{-1}$. The total pressure is from 200 psig to 3000 psig, or alternatively ranging from about 500 psia to about 2500 psia. Hydrogen feed rate, in terms of $H_2$/hydrocarbon ratio, are typically from 500 SCF/Bbl to 5000 SCF/bbl (89 to 890 $m^3$ $H_2/m^3$ feedstock), and are often between 1000 and 3500 SCF/Bbl. Reaction temperatures in the reactor will typically be in the range from about 300° F. to about 750° F. (about 150° C. to about 400° C.), or alternatively in the range from 450° F. to 725° F. (230° C. to 385° C.).

In practice, layered catalyst systems may be used comprising hydrotreating (HDT, HDM, DEMET, etc.), hydrocracking (HCR), hydrodewaxing (HDW), and hydrofinishing (HFN) catalysts to produce intermediate and/or finished base oils using single or multireactor systems. A typical configuration includes two reactors with the first reactor comprising layered catalysts providing DEMET, HDT pretreatment, HCR, and/or HDW activity. Differing catalysts performing similar functions, e.g., different levels of hydrocracking activity, may be used as well, e.g., in different layers within a single reactor or in separate reactors.

For the avoidance of doubt, the present application is directed to the subject-matter described in the following numbered paragraphs:

1. A process for making a bright stock base oil, comprising
   - contacting a base oil feedstream comprising an atmospheric resid feedstock, and, optionally, a base oil feedstock, with a hydrocracking catalyst under hydrocracking conditions to form a hydrocracked product;
   - separating the hydrocracked product into a gaseous fraction and a liquid fraction;
   - contacting the liquid fraction with a dewaxing catalyst under hydroisomerization conditions, to produce a dewaxed product; and
   - optionally, contacting the dewaxed product with a hydrofinishing catalyst under hydrofinishing conditions to produce a hydrofinished dewaxed product;
   - wherein the atmospheric resid feedstock has an API gravity greater than about 25° API, a nickel and vanadium content of less than about 2 ppm, an MCR of less than about 1 wt. % and an asphaltenes content of less than about 500 ppm and wherein the process produces a bright stock base oil product having a viscosity of at least about 22 cSt at 100° C.
2. The method of paragraph 1, which is used to modify a base oil process to produce a bright stock base oil having a viscosity of at least about 22 cSt at 100° C., wherein the base oil process comprises subjecting a base oil feedstream to hydrocracking and dewaxing steps to form a dewaxed product comprising a light product and a heavy product; the method comprising,
   - subjecting the base oil feedstream comprising the atmospheric resid feedstock to the hydrocracking and dewaxing steps of the base oil process;
   - wherein the modified base oil process comprises:
   - contacting a base oil feedstream comprising an atmospheric resid feedstock, and, optionally, a base oil feedstock, with a hydrocracking catalyst under hydrocracking conditions to form a hydrocracked product;
   - separating the hydrocracked product into at least a gaseous fraction and a liquid fraction;
   - contacting the liquid fraction with a dewaxing catalyst under hydroisomerization conditions, to produce a dewaxed product; and
   - optionally, contacting the dewaxed product with a hydrofinishing catalyst under hydrofinishing conditions to produce a hydrofinished dewaxed product;
   - wherein the modified process produces a bright stock base oil product having a viscosity of at least about 22 cSt at 100° C.
3. A process for making a bright stock base oil having a viscosity of at least about 22 cSt at 100° C. from a base oil feedstream, or a fraction thereof, according to paragraph 1, the process comprising
   - providing a base oil feedstream comprising an atmospheric resid feedstock, and, optionally, a base oil feedstock;
   - separating the base oil feedstream, or a fraction thereof, into a vacuum gas oil fraction having a front end cut point of about 700° F. or greater and a back end cut point of about 900° F. or less to form a medium vacuum gas oil MVGO fraction and a heavy vacuum gas oil HHVGO fraction; and using the HHVGO fraction as the atmospheric resid feedstock in the process of paragraph 1.

4. The process of any one of paragraphs 1-3, wherein the base oil feedstream includes a base oil feedstock.

5. The process of any one of paragraphs 1-4, wherein the atmospheric resid feedstock meets one or more of the following conditions:

API gravity in the range of 25-60 or 25-45, or, optionally, greater than the API of the base oil feedstock;

VI in the range of 50-200 or 70-190 or 90-180, or at least 80, or, optionally, greater than the VI of the base oil feedstock;

viscosity at 100° C. in the range of 3-30 cSt or 3-25 cSt or 3-20 cSt, or 3-10 cST, or at least 3 cSt, or at least 4 cSt, or less than 10 cSt;

viscosity at 70° C. in the range of 5-25 cSt or 5-20 cSt or 5-15 cSt, or at least 5 cSt, or at least 6 cSt;

hot $C_7$ asphaltene content in the range of 0.01-0.3 wt. % or 0.01-0.2 wt. % or 0.02-0.15 wt. %, or less than 0.3 wt. %, or less than 0.2 wt. %, or less than 0.1 wt. %;

wax content in the range of 5-40 wt. % or 5-30 wt. % or 10-25 wt. %, or at least 5 wt. % or at least 10 wt. %, or at least 15 wt. %, or, optionally, greater than the wax content of the base oil feedstock;

nitrogen content of less than 2500 ppm or less than 2000 ppm or less than 1500 ppm or less than 1000 ppm or less than 800 ppm or less than 500 ppm or less than 200 ppm or less than 100 ppm;

sulfur content of less than 8000 ppm or less than 6000 ppm or less than 4000 ppm or less than 3000 ppm or less than 2000 ppm or less than 1000 ppm or less than 500 ppm or less than 200 ppm, or in the range of 100-8000 ppm or 100-6000 ppm or 100-4000 ppm or 100-2000 ppm or 100-1000 ppm or 100-500 ppm or 100-200 ppm; and/or 1050+° F. content in the range of 5-50 wt. % or 2-40 wt. % or 4-50 wt. % or 4-40 wt. % or 8-50 wt. % 8-40 wt. %, or up to 50 wt. %, or up to 40 wt. %, or up to 30 wt. %, or up to 20 wt. %, or up to 10 wt. %, optionally, greater than the 1050+° F. content of the base oil feedstock.

6. The process of any one of paragraphs 1-5, wherein the atmospheric resid feedstock has a hot $C_7$ asphaltene content in the range of less than about 0.3 wt. %, or less than about 0.2 wt. %, or less than about 0.1 wt. %; and a nitrogen content of less than 2500 ppm, or less than 2000 ppm, or less than 1500 ppm, or less than 1000 ppm, or less than 800 ppm, or less than 500 ppm, or less than 200 ppm, or less than 100 ppm.

7. The process of any one of paragraphs 1-6, wherein the atmospheric resid feedstock has a hot $C_7$ asphaltene content in the range of less than about 0.3 wt. %, or less than about 0.2 wt. %, or less than about 0.1 wt. %; a nitrogen content of less than 2500 ppm, or less than 2000 ppm, or less than 1500, ppm or less than 1000 ppm, or less than 800 ppm, or less than 500 ppm, or less than 200 ppm, or less than 100 ppm; and a metals content of: less than about 5 ppm Nickel, or less than about 3 ppm Vanadium, or less than about 4 ppm Iron, or a combination thereof.

8. The process of any one of paragraphs 1-7, wherein the atmospheric resid feedstock meets the following conditions:

viscosity at 100° C. of less than 10 cSt, or in the range of 3-10 cSt;

hot $C_7$ asphaltene content of less than about 0.1 wt. %, or in the range of about 0.01-0.1 wt. %; MCRT of less than 2 wt. %;

nitrogen content of less than 800 ppm;

sulfur content of less than 3000 ppm;

Nickel content of less than 5 ppm;

Vanadium content of less than 3 ppm; and

Iron content of less than 4 ppm.

9. The process of any one of paragraphs 1-8, wherein the base oil feedstock meets one or more of the following conditions:

API gravity in the range of 15-40 or 15-30 or 15-25, or at least 15, or at least 17, optionally, less than the atmospheric resid feedstock;

VI in the range of 30-90 or 40-90 or 50-90 or 50-80, optionally, less than the VI of the atmospheric resid feedstock;

viscosity at 100° C. in the range of 3-30 cSt or 3-25 cSt or 3-20 cSt, or at least 3 cSt, or at least 4 cSt;

viscosity at 70° C. in the range of 5-50 cSt or 5-80 wt. % or 5-70 wt. % or 5-60 wt. % or 5-50 wt. % or 5-40 wt. % or 5-30 wt. % or 5-20 cSt or 5-15 cSt, or at least 5 cSt, or at least 6 cSt;

hot $C_7$ asphaltene content in the range of 0.01-0.3 wt. % or 0.01-0.2 wt. % or 0.02-0.15 wt. %, or less than 0.3 wt. %, or less than 0.2 wt. %;

wax content in the range of 5-90 wt. % or 5-80 wt. % or 5-70 wt. % or 5-60 wt. % or 5-50 wt. % or 5-40 wt. % or 5-30 wt. % or 10-25 wt. %, or at least 5 wt. % or at least 10 wt. %, or at least 15 wt. %, or, optionally, less than the wax content of the atmospheric resid feedstock;

nitrogen content of less than 2500 ppm or less than 2000 ppm or less than 1500 ppm or less than 1000 ppm, or in the range of 1000-5000 ppm, or 2000-5000 ppm, or 1000-4000 ppm, or 1000-3000 ppm;

sulfur content of less than 40000 ppm, or less than 35000 ppm, or less than 30000 ppm, or less than 25000 ppm, or less than 20000 ppm, or less than 15000 ppm, or less than 10000 ppm, or in the range of 1000-40000 ppm or 1000-35000 ppm or 1000-30000 ppm or 1000-25000 ppm or 1000-15000 ppm or 1000-10000 ppm; and/or 1050+° F. content of less than 10 wt. %, or less than 8 wt. %, or less than 7 wt. %, or less than 6 wt. %, or less than 5 wt. %, or less than 4 wt. %, or less than 3 wt. %, or less than 2 wt. %, or in the range of 2-15 wt. % or 2-10 wt. % or 1-7 wt. %, optionally, less than the 1050+° F. content of the atmospheric resid feedstock.

10. The process of any one of paragraphs 1-9, wherein the base oil feedstock has a nitrogen content of less than 2500 ppm or less than 2000 ppm or less than 1500 ppm or less than 1000 ppm, or in the range of 1000-5000 ppm, or 2000-5000 ppm, or 1000-4000 ppm, or 1000-3000 ppm; or a sulfur content of less than 40000 ppm, or less than 35000 ppm, or less than 30000 ppm, or less than 25000 ppm, or less than 20000 ppm, or less than 15000 ppm, or less than 10000 ppm, or in the range of 1000-40000 ppm or 1000-35000 ppm or 1000-30000 ppm or 1000-25000 ppm or 1000-15000 ppm or 1000-10000 ppm; or a 1050+° F. content of less than 10 wt. %, or less than 8 wt. %, or less than 7 wt. %, or less than 6 wt. %, or less than 5 wt. %, or less than 4 wt. %, or less than 3 wt. %, or less than 2 wt. %, or in the range of 2-15 wt. % or 2-10 wt. % or 1-7 wt. %, optionally, less than the 1050+° F. content of the atmospheric resid feedstock, or a combination thereof.

11. The process of any one of paragraphs 1-10, wherein the base oil feedstream comprises 5-95 wt. % atmospheric resid feedstock and 95-5 wt. % base oil feedstock, or 10-90 wt. % atmospheric resid feedstock and 90-10 wt. % base oil feedstock, or 10-80 wt. % atmospheric resid feedstock and 90-20 wt. % base oil feedstock, or 10-60 wt. % atmospheric resid feedstock and 90-40 wt. % base oil feedstock, or 10-50 wt. % atmospheric resid feedstock and 50-90 wt. % base oil feedstock, or 10-40 wt. % atmospheric resid feedstock and 90-60 wt. % base oil feedstock, or 10-30 wt. % atmospheric resid feedstock and 90-70 wt. % base oil feedstock, or 30-60 wt. % atmospheric resid feedstock and 70-40 wt. % base oil feedstock, or 40-60 wt. % atmospheric resid feedstock and 60-40 wt. % base oil feedstock.
12. The process of any one of paragraphs 1-11, wherein the base oil feedstream does not contain an added whole crude oil feedstock, or wherein the base oil feedstream does not contain a vacuum residue feedstock, or wherein the base oil feedstream does not contain a deasphalted oil, or wherein the base oil feedstream contains only atmospheric resid feedstock and, optionally, a base oil feedstock.
13. The process of any one of paragraphs 1-12, wherein the process does not include recycle of a liquid feedstock as part of the base oil feedstream or as either or both of the atmospheric resid feedstock and the base oil feedstock.
14. The process of any one of paragraphs 1-13, wherein the atmospheric resid feedstock and the base oil feedstock are not the same.
15. The process of paragraph 14, wherein the atmospheric resid feedstock and the base oil feedstock differ in nitrogen content, sulfur content, 1050+° F. content, or a combination thereof.
16. The process of any one of paragraphs 1-15, wherein the base oil feedstock comprises vacuum gas oil or is vacuum gas oil, or consists essentially of vacuum gas oil, or consists of vacuum gas oil.
17. The process of any one of paragraphs 1-16, wherein the vacuum gas oil is a heavy vacuum gas oil obtained from vacuum gas oil that is cut into a light fraction and a heavy fraction, with the heavy fraction having a cut point temperature range of about 950-1050° F.
18. The process of any one of paragraphs 1-17, wherein the dewaxed product and/or the hydrofinished dewaxed product is obtained as a light base oil product and a heavy base oil product.
19. The process of paragraph 18, wherein the light base oil product has a nominal viscosity in the range of 3-9 cSt, or 4-8 cSt or 5-7 cSt at 100° C. and/or the heavy base oil product has a nominal viscosity in the range of 13-24 cSt, or 13-21 cSt, or 13-18 cSt at 100° C.
20. The process of paragraph 18, wherein the yield of the heavy base oil product relative to the light base oil product is increased by at least about 0.5 Lvol. %, or at least about 1 Lvol. % or at least about 2 Lvol % or at least about 5 Lvol % compared with the same process that does not include the atmospheric resid feedstock in the base oil feedstream.
21. The process of paragraph 18, wherein the total waxy base oil yield is increased by at least about 0.5 Lvol. %, or at least about 1 Lvol. % or at least about 2 Lvol % or at least about 5 Lvol % compared with the same process that does not include the atmospheric resid feedstock in the base oil feedstream.
22. The process any one of paragraphs 1-21, wherein the dewaxed product is further separated into at least a lighter product having a nominal viscosity of 5.5 to 7.5 cSt at 100° C., or at least a heavier product having a nominal viscosity of 13 cSt or greater at 100° C., or 13-16.5 cSt at 100° C., or 18-23 cSt at 100° C., or a combination thereof.
23. The process of paragraph 3, further comprising
    contacting the MVGO fraction with a hydrocracking catalyst under hydrocracking conditions to form a hydrocracked product;
    separating the hydrocracked product into a gaseous fraction and a liquid fraction;
    contacting the liquid fraction with a dewaxing catalyst under hydroisomerization conditions, to produce a dewaxed product; and
    optionally, contacting the dewaxed product with a hydrofinishing catalyst under hydrofinishing conditions to produce a hydrofinished dewaxed product;
    wherein, the dewaxed product and/or the hydrofinished dewaxed product has a viscosity index of 120 or greater after dewaxing.
24. The process of paragraph 23, wherein the dewaxed product and/or the hydrofinished dewaxed product has a viscosity index of 130 or greater after dewaxing, or 135 or greater after dewaxing, or 140 or greater after dewaxing.
25. The process of paragraph 23, wherein the dewaxed product and/or the hydrofinished dewaxed product comprises a Group III or Group III+ base oil product.
26. The process of paragraph 23, wherein the hydrocracked product has a viscosity index of at least about 135, or 140, or 145, or 150.
27. The process of any one of paragraphs 1-26, wherein the base oil feedstock comprises tight oil, or a fraction thereof and/or the atmospheric resid feedstock is derived from a tight oil, or a fraction thereof.

EXAMPLES

Samples of vacuum gas oil (VGO) and atmospheric resid (AR) were obtained from commercially available sources and used in the process scheme illustrated in FIG. 2*a*. The AR was fed directly to the base oil hydrocracker, optionally with the VGO, and without solvent de-asphalting pre-treatment.

Process conditions used included 0.5 $hr^{-1}$ LHSV, reactor $H_2$ partial pressure of 1700-1800 psia, hydrogen feed gas oil (recycle) ratio of about 4500 scfb, and reactor temperatures in the range of 700-770+° F. Temperature and other process conditions were selected to produce a light base oil target product having a VI of about 109 and a viscosity at 100° C. of about 6 cSt.

The catalyst loading in each of the reactors according to FIG. 2*a* was a conventional scheme for base oil production as described hereinabove. The catalyst configuration included layered catalyst systems comprising layers of base metal hydrodemetalation (demet) catalysts at the top of the reactor catalyst bed, followed by base metal hydrotreating catalysts and then by layers of zeolite-containing base metal hydrocracking catalysts of increasing activity.

Example 1—Vacuum Gas Oil (VGO) Feedstock (Comparative Feedstock)

A sample of vacuum gas oil (VGO) feedstock from a commercially available source used to produce base oil products was obtained and analyzed as a comparative base case. The VGO feedstock was used in the following examples according to the process configurations shown in FIGS. 1 and 2*a*. The properties of this VGO feedstock (sample ID 2358) are shown in Table 1.

TABLE 1

Properties of Vacuum Gas Oil (VGO) Feedstock

| Feed Property | VGO Property Value |
|---|---|
| API Gravity | 18 |
| Viscosity Index, VI (D2270) | 52 |
| Viscosity, 100° C. (cSt) | 13.23 |
| Viscosity, 70° C. (cSt) | 37.56 |
| Hot C7 Asphaltenes (wt. %) | |
| wax content (wt. %) | 7 |
| N content (ppm) | 1620 |
| S content (ppm) | 31420 |
| 1050+ (wt. %) | 4.7 |
| Simdist (° F.) | |
| IBP | 525 |
| 5% | 707 |
| 15% | 776 |
| 20% | 795 |
| 30% | 827 |
| 35% | 841 |

TABLE 1-continued

Properties of Vacuum Gas Oil (VGO) Feedstock

| Feed Property | VGO Property Value |
|---|---|
| 40% | 855 |
| 45% | 870 |
| 50% | 883 |
| 55% | 897 |
| 60% | 912 |
| 65% | 927 |
| 70% | 941 |
| 75% | 957 |
| 80% | 975 |
| 85% | 994 |
| 90% | 1016 |
| 95% | 1048 |
| 99% | 1099 |
| EP | 1116 |

Example 2—Properties of Atmospheric Resid (AR) Feedstocks

Samples of atmospheric resids (AR1 to AR5) from commercially available sources were obtained and analyzed. The properties of these AR samples, which were used as feedstock components according to the invention, are shown in Table 2.

TABLE 2

Properties of Atmospheric Resid (AR) Feedstocks

| Feed | AR Sample Property Value | | | | |
|---|---|---|---|---|---|
| Property | AR1 | AR2 | AR3 | AR4 | AR5 |
| Sample ID | 2147 | 2188 | 2361 | 2591 | 2614 |
| API Gravity | 26.6 | 36.5 | 28.9 | 32.6 | 32.6 |
| Viscosity Index, VI (D2270) | 108 | 137 | 106 | 134 | 123 |
| Viscosity, 100° C. (cSt) | 13.23 | 3.843 | 8.683 | 6.425 | 6.511 |
| Viscosity, 70° C. (cSt) | | 6.957 | | 13.04 | 13.5 |
| Hot C7 Asphaltenes (wt. %) | | | 0.12 | 0.0234 | 0.0379 |
| wax content (wt. %) | | 24 | 14 | 25 | 21 |
| N content (ppm) | 808 | 70.7 | 623 | 340 | 271 |
| S content (ppm) | 5654 | 805 | 3938 | 2266 | 558 |
| 1050+° F. (wt. %) | 24.2 | 8.3 | 15.6 | 11.9 | 14.3 |
| Simdist (° F.) | | | | | |
| IBP | 439 | 319 | 573 | 431 | 310 |
| 5% | 644 | 477 | 672 | 589 | 543 |
| 15% | 737 | 578 | 722 | 673 | 677 |
| 20% | 766 | 608 | 741 | 699 | 717 |
| 30% | 814 | 666 | 775 | 746 | 774 |
| 35% | 837 | 691 | 792 | 767 | 796 |
| 40% | 860 | 715 | 810 | 785 | 816 |
| 45% | 884 | 737 | 828 | 804 | 836 |
| 50% | 907 | 761 | 849 | 824 | 856 |
| 55% | 931 | 785 | 871 | 845 | 876 |
| 60% | 956 | 809 | 893 | 869 | 896 |
| 65% | 984 | 836 | 918 | 893 | 919 |
| 70% | 1013 | 865 | 944 | 920 | 942 |
| 75% | 1045 | 897 | 976 | 948 | 971 |
| 80% | 1078 | 932 | 1011 | 982 | 1003 |
| 85% | 1116 | 974 | 1056 | 1022 | 1044 |
| 90% | 1163 | 1028 | 1111 | 1070 | 1096 |
| 95% | 1224 | 1103 | 1185 | 1136 | 1173 |
| 99% | 1312 | 1217 | 1268 | 1230 | 1312 |
| EP | 1329 | 1250 | 1279 | 1230 | 1339 |

Table 2A provides properties for a comparative conventional AR base oil process feedstock component. As may be noted, the AR's shown in Table 2 differ significantly from AR0 shown in Table 2A.

TABLE 2A

| Properties of Representative Conventional Atmospheric Resid (AR) Feedstock | |
|---|---|
| Feed Property | AR0 Sample Property Value |
| API Gravity | 10.7 |
| Viscosity, 100° C. (cSt) | 123.7 |
| Viscosity, 70° C. (cSt) | 2030.5 |
| Hot C7 Asphaltenes (wt. %) | 9.9 |
| N content (ppm) | 3492 |
| S content (ppm) | 48262 |
| Ni (ppm) | 43.7 |

TABLE 2A-continued

| Properties of Representative Conventional Atmospheric Resid (AR) Feedstock | |
|---|---|
| Feed Property | AR0 Sample Property Value |
| V (ppm) | 180.0 |
| MCRT (wt. %) | 14.3 |

Example 3—Properties of Blends of Atmospheric Resid (AR) Feedstocks with Vacuum Gas Oil (VGO) Feedstock Samples of the atmospheric resids AR1 to AR5 of example 2 were blended with the vacuum gas oil (VGO) feedstock of example 1 on a weight ratio basis and the blends analyzed. The properties of these AR/VGO blend samples, which were used as illustrative feedstocks according to the invention, are shown in Table 3.

TABLE 3

| Properties of Atmospheric Resid (AR) and Vacuum Gas Oil (VGO) Feedstock Blends | | | | | | |
|---|---|---|---|---|---|---|
| | AR/VGO Blend (wt/wt) Sample Property Value | | | | | |
| Feed Property | 45% AR1/ 55% VGO | 50% AR2/ 50% VGO | 53% AR3/ 47% VGO | 20% AR4/ 80% VGO | 20% AR5/ 80% VGO | 50% AR4/ 50% VGO |
| Sample ID | 2148 | 2190 | 2394 | 3924 | 4122 | 7200 |
| API Gravity | 20.9 | 25.9 | 19.9 | 19.9 | 20.6 | 24.3 |
| Viscosity Index, VI (D2270) | 73 | 100 | 63 | 72 | 69 | 97 |
| Viscosity, 100° C. (cSt) | 13.68 | 6.912 | 11.99 | 11.63 | 11.12 | 8.783 |
| Viscosity, 70° C. (cSt) | 37.28 | 15.21 | 32.4 | 30.59 | 29.12 | 20.45 |
| Hot C7 Asphaltenes (wt. %) | | | 0.0386 | | | |
| wax content (wt. %) | | 18 | 8 | | | 15 |
| N content (ppm) | 1540 | 1050 | 1460 | 1230 | 1270 | 991 |
| S content (ppm) | 20490 | 15630 | 26160 | 26620 | 25880 | 17430 |
| 1050+ (wt. %) | | 6.4 | 6 | 6.8 | 7.3 | 9.3 |
| Simdist (° F.) | | | | | | |
| IBP | 633 | 383 | 603 | 568 | 504 | 517 |
| 5% | 702 | 551 | 696 | 693 | 676 | 633 |
| 10% | 750 | 622 | 736 | 737 | 729 | 689 |
| 15% | 781 | 674 | 763 | 765 | 761 | 724 |
| 20% | 804 | 716 | 785 | 786 | 784 | 753 |
| 25% | 823 | 750 | 802 | 804 | 801 | 775 |
| 30% | 840 | 778 | 819 | 820 | 818 | 794 |
| 35% | 856 | 802 | 834 | 835 | 833 | 812 |
| 40% | 871 | 823 | 849 | 850 | 848 | 829 |
| 45% | 885 | 841 | 864 | 865 | 864 | 847 |
| 50% | 899 | 860 | 878 | 880 | 879 | 864 |
| 55% | 915 | 877 | 893 | 895 | 894 | 882 |
| 60% | 930 | 894 | 908 | 910 | 910 | 899 |
| 65% | 944 | 912 | 925 | 927 | 926 | 919 |
| 70% | 960 | 929 | 940 | 942 | 942 | 938 |
| 75% | 978 | 947 | 958 | 960 | 960 | 959 |
| 80% | 999 | 969 | 977 | 979 | 980 | 983 |
| 85% | 1023 | 992 | 998 | 1000 | 1002 | 1009 |
| 90% | 1058 | 1021 | 1023 | 1027 | 1030 | 1044 |
| 95% | 1132 | 1064 | 1059 | 1066 | 1075 | 1101 |
| 99% | 1293 | 1172 | 1136 | 1166 | 1246 | 1234 |
| EP | 1327 | 1216 | 1170 | 1204 | 1313 | 1267 |

Example 4—Evaluation of Bright Stock Base Oil Production from Blends of Atmospheric Resid (AR) Feedstock with Vacuum Gas Oil (VGO) Feedstock—AR1/VGO Blend The blend feedstock sample of the atmospheric resid AR1 with vacuum gas oil (VGO) of example 3 was evaluated for heavy base oil production according to the process represented by FIG. 2*a*. The AR1/VGO feedstock blend (45 wt. % AR1, 55 wt. % VGO) whole liquid product was distilled into eight fractions, the heaviest of which had a 911° F. cut point. A distillation model showed a whole liquid product of 40,000 BPOD hydrocracker feed could be distilled into a product of:

6,150 BPOD bright stock base oil product (29.9 cSt at 100° C., VI of 117, 1005° F.+), corresponding to 11% of the product;

8,310 BPOD waxy heavy 600 neutral base oil product (11.69 cSt at 100° C., VI of 112, 898-1005° F.), corresponding to 15% of the product;

13,010 BPOD waxy 220 neutral base oil product (6.0 cSt at 100° C., VI of 108. 754-898° F.), corresponding to 24% of the product; and 27,470 BPOD total waxy base oil products, 754° F.+ oils, corresponding to 50% of the liquid product.

In the foregoing examples, the use of atmospheric resid as a feedstock or feedstock blend is shown to advantageously allow extra-heavy grades of base oils including bright stock to be made following an all-hydroprocessing route. Use of an AR feed component may result in higher yields and higher product quality and allow feed blends with heavier components and higher end points to be processed. While variations in the fractionation targets and conditions may result in base oil products with additional or different properties, the use of an atmospheric resid feedstock may enable production of extra heavy base oils including bright stock not generally attainable by processing typical or standard base oil feedstocks alone and without the use of solvent de-asphalting.

The foregoing description of one or more embodiments of the invention is primarily for illustrative purposes, it being recognized that variations might be used which would still incorporate the essence of the invention. Reference should be made to the following claims in determining the scope of the invention.

For the purposes of U.S. patent practice, and in other patent offices where permitted, all patents and publications cited in the foregoing description of the invention are incorporated herein by reference to the extent that any information contained therein is consistent with and/or supplements the foregoing disclosure.

What is claimed is:

1. A process for making a bright stock base oil, comprising contacting a base oil feedstream comprising an atmospheric resid feedstock, and, optionally, a base oil feedstock, with a hydrocracking catalyst under hydrocracking conditions to form a hydrocracked product;

separating the hydrocracked product into a gaseous fraction and a liquid fraction;

contacting the liquid fraction with a dewaxing catalyst under hydroisomerization conditions, to produce a dewaxed product; and optionally, contacting the dewaxed product with a hydrofinishing catalyst under hydrofinishing conditions to produce a hydrofinished dewaxed product;

wherein the atmospheric resid feedstock has an API gravity greater than about 25° API, a nickel and vanadium content of less than about 2 ppm, an MCR of less than about 1 wt. %, an asphaltenes content of less than about 500 ppm, a viscosity at 100*C of less than 10 cSt, or in the range of 3-10 cSt; and wherein the process produces a bright stock base oil product having a viscosity of at least about 22 cSt at 100° C.

2. A process for making a bright stock base oil having a viscosity of at least about 22 cSt at 100° C. from a base oil feedstream, or a fraction thereof, according to claim 1, the process comprising providing a base oil feedstream comprising an atmospheric resid feedstock, and, optionally, a base oil feedstock;

separating the base oil feedstream, or a fraction thereof, into a vacuum gas oil fraction having a front end cut point of about 700° F. or greater and a back end cut point of about 900° F. or less to form a medium vacuum gas oil MVGO fraction and a heavy vacuum gas oil HHVGO fraction; and using the HHVGO fraction as the atmospheric resid feedstock in the process of claim 1.

3. The process of claim 1, wherein the base oil feedstream includes a base oil feedstock.

4. The process of claim 1, wherein the atmospheric resid feedstock meets one or more of the following conditions:

API gravity in the range of 25-60 or 25-45, or, optionally, greater than the API of the base oil feedstock;

VI in the range of 50-200 or 70-190 or 90-180, or at least 80, or, optionally, greater than the VI of the base oil feedstock;

viscosity at 70° C. in the range of 5-25 cSt or 5-20 cSt or 5-15 cSt, or at least 5 cSt, or at least 6 cSt;

wax content in the range of 5-40 wt. % or 5-30 wt. % or 10-25 wt. %, or at least 5 wt. % or at least 10 wt. %, or at least 15 wt. %, or, optionally, greater than the wax content of the base oil feedstock;

nitrogen content of less 500 ppm or less than 200 ppm or less than 100 ppm;

sulfur content of less than 2000 ppm or less than 1000 ppm or less than 500 ppm or less than 200 ppm, or in the range of 100-2000 ppm or 100-1000 ppm or 100-500 ppm or 100-200 ppm; and/or 1050+° F. content in the range of 5-50 wt. % or 2-40 wt. % or 4-50 wt. % or 4-40 wt. % or 8-50 wt. % 8-40 wt. %, or up to 50 wt. %, or up to 40 wt. %, or up to 30 wt. %, or up to 20 wt. %, or up to 10 wt. %, optionally, greater than the 1050+° F. content of the base oil feedstock.

5. The process of claim 1, wherein the base oil feedstock meets one or more of the following conditions:

API gravity in the range of 15-40 or 15-30 or 15-25, or at least 15, or at least 17, optionally, less than the atmospheric resid feedstock;

VI in the range of 30-90 or 40-90 or 50-90 or 50-80, optionally, less than the VI of the atmospheric resid feedstock;

viscosity at 100° C. in the range of 3-30 cSt or 3-25 cSt or 3-20 cSt, or at least 3 cSt, or at least 4 cSt;

viscosity at 70° C. in the range of 5-50 cSt or 5-80 wt. % or 5-70 wt. % or 5-60 wt. % or 5-50 wt. % or 5-40 wt. % or 5-30 wt. % or 5-20 cSt or 5-15 cSt, or at least 5 cSt, or at least 6 cSt;

hot $C_7$ asphaltene content in the range of 0.01-0.3 wt. % or 0.01-0.2 wt. % or 0.02-0.15 wt. %, or less than 0.3 wt. %, or less than 0.2 wt. %;

wax content in the range of 5-90 wt. % or 5-80 wt. % or 5-70 wt. % or 5-60 wt. % or 5-50 wt. % or 5-40 wt. % or 5-30 wt. % or 10-25 wt. %, or at least 5 wt. % or at least 10 wt. %, or at least 15 wt. %, or, optionally, less than the wax content of the atmospheric resid feedstock;

nitrogen content of less than 2500 ppm or less than 2000 ppm or less than 1500 ppm or less than 1000 ppm, or in the range of 1000-5000 ppm, or 2000-5000 ppm, or 1000-4000 ppm, or 1000-3000 ppm;

sulfur content of less than 40000 ppm, or less than 35000 ppm, or less than 30000 ppm, or less than 25000 ppm, or less than 20000 ppm, or less than 15000 ppm, or less than 10000 ppm, or in the range of 1000-40000 ppm or 1000-35000 ppm or 1000-30000 ppm or 1000-25000 ppm or 1000-15000 ppm or 1000-10000 ppm; and/or 1050+° F. content of less than 10 wt. %, or less than 8 wt. %, or less than 7 wt. %, or less than 6 wt. %, or less than 5 wt. %, or less than 4 wt. %, or less than 3 wt. %, or less than 2 wt. %, or in the range of 2-15 wt. % or 2-10 wt. % or 1-7 wt. %, optionally, less than the 1050+° F. content of the atmospheric resid feedstock.

6. The process of claim 1, wherein the base oil feedstock has a nitrogen content of less than 2500 ppm or less than 2000 ppm or less than 1500 ppm or less than 1000 ppm, or in the range of 1000-5000 ppm, or 2000-5000 ppm, or 1000-4000 ppm, or 1000-3000 ppm; or a sulfur content of less than 40000 ppm, or less than 35000 ppm, or less than 30000 ppm, or less than 25000 ppm, or less than 20000 ppm, or less than 15000 ppm, or less than 10000 ppm, or in the range of 1000-40000 ppm or 1000-35000 ppm or 1000-30000 ppm or 1000-25000 ppm or 1000-15000 ppm or 1000-10000 ppm; or a 1050+° F. content of less than 10 wt. %, or less than 8 wt. %, or less than 7 wt. %, or less than 6 wt. %, or less than 5 wt. %, or less than 4 wt. %, or less than 3 wt. %, or less than 2 wt. %, or in the range of 2-15 wt. % or 2-10 wt. % or 1-7 wt. %, optionally, less than the 1050+° F. content of the atmospheric resid feedstock, or a combination thereof.

7. The process of claim 1, wherein the base oil feedstream comprises 5-95 wt. % atmospheric resid feedstock and 95-5 wt. % base oil feedstock, or 10-90 wt. % atmospheric resid feedstock and 90-10 wt. % base oil feedstock, or 10-80 wt. % atmospheric resid feedstock and 90-20 wt. % base oil feedstock, or 10-60 wt. % atmospheric resid feedstock and 90-40 wt. % base oil feedstock, or 10-50 wt. % atmospheric resid feedstock and 50-90 wt. % base oil feedstock, or 10-40 wt. % atmospheric resid feedstock and 90-60 wt. % base oil feedstock, or 10-30 wt. % atmospheric resid feedstock and 90-70 wt. % base oil feedstock, or 30-60 wt. % atmospheric resid feedstock and 70-40 wt. % base oil feedstock, or 40-60 wt. % atmospheric resid feedstock and 60-40 wt. % base oil feedstock.

8. The process of claim 1, wherein the base oil feedstream does not contain an added whole crude oil feedstock, or wherein the base oil feedstream does not contain a vacuum residue feedstock, or wherein the base oil feedstream does not contain a deasphalted oil, or wherein the base oil feedstream contains only atmospheric resid feedstock and, optionally, a base oil feedstock.

9. The process of claim 1, wherein the process does not include recycle of a liquid feedstock as part of the base oil feedstream or as either or both of the atmospheric resid feedstock and the base oil feedstock.

10. The process of claim 1, wherein the atmospheric resid feedstock and the base oil feedstock are not the same.

11. The process of claim 10, wherein the atmospheric resid feedstock and the base oil feedstock differ in nitrogen content, sulfur content, 1050+° F. content, or a combination thereof.

12. The process of claim 1, wherein the base oil feedstock comprises vacuum gas oil or is vacuum gas oil, or consists essentially of vacuum gas oil, or consists of vacuum gas oil.

13. The process of claim 12, wherein the vacuum gas oil is a heavy vacuum gas oil obtained from vacuum gas oil that is cut into a light fraction and a heavy fraction, with the heavy fraction having a cut point temperature range of about 950-1050° F.

14. The process of claim 1, wherein the dewaxed product and/or the hydrofinished dewaxed product is obtained as a light base oil product and a heavy base oil product.

15. The process of claim 14, wherein the light base oil product has a nominal viscosity in the range of 3-9 cSt, or 4-8 cSt or 5-7 cSt at 100° C. and/or the heavy base oil product has a nominal viscosity in the range of 13-24 cSt, or 13-21 cSt, or 13-18 cSt at 100° C.

16. The process of claim 14, wherein the yield of the heavy base oil product relative to the light base oil product is increased by at least about 0.5 Lvol. %, or at least about 1 Lvol. % or at least about 2 Lvol % or at least about 5 Lvol % compared with the same process that does not include the atmospheric resid feedstock in the base oil feedstream.

17. The process of claim 14, wherein the total waxy base oil yield is increased by at least about 0.5 Lvol. %, or at least about 1 Lvol. % or at least about 2 Lvol % or at least about 5 Lvol % compared with the same process that does not include the atmospheric resid feedstock in the base oil feedstream.

18. The process of claim 1, wherein the dewaxed product is further separated into at least a lighter product having a nominal viscosity of 5.5 to 7.5 cSt at 100° C., or at least a heavier product having a nominal viscosity of 13 cSt or greater at 100° C., or 13-16.5 cSt at 100° C., or 18-23 cSt at 100° C., or a combination thereof.

19. The process of claim 2, further comprising contacting the MVGO fraction with a hydrocracking catalyst under hydrocracking conditions to form a hydrocracked product;

separating the hydrocracked product into a gaseous fraction and a liquid fraction;

contacting the liquid fraction with a dewaxing catalyst under hydroisomerization conditions, to produce a dewaxed product; and optionally, contacting the dewaxed product with a hydrofinishing catalyst under hydrofinishing conditions to produce a hydrofinished dewaxed product;

wherein, the dewaxed product and/or the hydrofinished dewaxed product has a viscosity index of 120 or greater after dewaxing.

20. The process of claim 19, wherein the dewaxed product and/or the hydrofinished dewaxed product has a viscosity index of 130 or greater after dewaxing, or 135 or greater after dewaxing, or 140 or greater after dewaxing.

21. The process of claim 19, wherein the dewaxed product and/or the hydrofinished dewaxed product comprises a Group III or Group III+ base oil product.

22. The process of claim 19, wherein the hydrocracked product has a viscosity index of at least about 135, or 140, or 145, or 150.

23. The process of claim 1, wherein the base oil feedstock comprises tight oil, or a fraction thereof and/or the atmospheric resid feedstock is derived from a tight oil, or a fraction thereof.

24. A process for making a bright stock base oil having a viscosity of at least about 22 cSt at 100° C. from a base oil feedstream, or a fraction thereof, the process comprising providing a base oil feedstream comprising an atmospheric resid feedstock, and, optionally, a base oil feedstock;

separating the base oil feedstream, or a fraction thereof, into a vacuum gas oil fraction having a front end cut point of about 700° F. or greater and a back end cut point of about 900° F. or less to form a medium vacuum gas oil MVGO fraction and a heavy vacuum gas oil HHVGO fraction;

contacting a base oil feedstream comprising the HHVGO fraction, and, optionally, a base oil feedstock, with a hydrocracking catalyst under hydrocracking conditions to form a hydrocracked product;

separating the hydrocracked product into a gaseous fraction and a liquid fraction;

contacting the liquid fraction with a dewaxing catalyst under hydroisomerization conditions, to produce a dewaxed product; and optionally, contacting the dewaxed product with a hydrofinishing catalyst under hydrofinishing conditions to produce a hydrofinished dewaxed product;

wherein the atmospheric resid feedstock has an API gravity greater than about 25° API, a nickel and vanadium content of less than about 2 ppm, an MCR of less than about 1 wt. % and an asphaltenes content of less than about 500 ppm and wherein the process produces a bright stock base oil product having a viscosity of at least about 22 cSt at 100° C.

25. The process of claim 24, further comprising contacting the MVGO fraction with a hydrocracking catalyst under hydrocracking conditions to form a hydrocracked product;

separating the hydrocracked product into a gaseous fraction and a liquid fraction;

contacting the liquid fraction with a dewaxing catalyst under hydroisomerization conditions, to produce a dewaxed product; and optionally, contacting the dewaxed product with a hydrofinishing catalyst under hydrofinishing conditions to produce a hydrofinished dewaxed product;

wherein, the dewaxed product and/or the hydrofinished dewaxed product has a viscosity index of 120 or greater after dewaxing.

26. The process of claim 25, wherein the dewaxed product and/or the hydrofinished dewaxed product has a viscosity index of 130 or greater after dewaxing, or 135 or greater after dewaxing, or 140 or greater after dewaxing; or wherein the dewaxed product and/or the hydrofinished dewaxed product comprises a Group Ill or Group III+ base oil product; or wherein the hydrocracked product has a viscosity index of at least about 135, or 140, or 145, or 150.

* * * * *